United States Patent [19]

Garcia

[11] Patent Number: 4,569,324

[45] Date of Patent: Feb. 11, 1986

[54] HAND HELD SURE GRIP SLINGSHOT INCLUDING A METHOD AND APPARATUS FOR ITS MANUFACTURE

[76] Inventor: Florentino Garcia, 1501 E. Beech St., Yakima, Wash. 98901

[21] Appl. No.: 534,317

[22] Filed: Sep. 22, 1983

[51] Int. Cl.[4] ..... F41B 3/00

[52] U.S. Cl. ..... 124/20 R; 140/71 R

[58] Field of Search ..... 124/20 R, 20 A, 20 B

[56] References Cited

U.S. PATENT DOCUMENTS

| | | | |
|---|---|---|---|
| 344,840 | 7/1886 | Lester | 124/20 R |
| 822,190 | 5/1906 | Curry | 124/20 R |
| 1,581,626 | 4/1926 | Barth | 124/20 R |
| 2,645,217 | 7/1953 | Fisher | 124/20 B |
| 2,667,863 | 2/1954 | Styles | 124/20 R |
| 3,517,657 | 6/1970 | Alban | 124/20 B |

*Primary Examiner*—Richard J. Apley
*Assistant Examiner*—William R. Browne
*Attorney, Agent, or Firm*—Roy E. Mattern, Jr.

[57] ABSTRACT

A hand held sure grip slingshot for launching projectiles is provided including a method and apparatus for its manufacture. The preferred embodiment of the slingshot comprises generally a one piece frame and a sling which includes a pair of elastic members detachably connected to the one piece frame and a pouch connected at its ends to the elastic members and intermediately positioned on the sling. The one piece frame is preferably constructed of structural wire and includes a handle commencing at its lower end, looping finger guides intermediately positioned on the frame at the top of the handle, upward extending and separating arms forming with the handle of Y-configuration, and spiral retaining loops at the upper end of the frame at the tops of the upward extending arms. The looping finger guides, adjacent to the top of the handle, comprise apertures, through which fingers of the operator's hand may be insertably positioned to minimize rotation and slipping during use of the slingshot. In performing the preferred embodiment of the method, while using a preferred embodiment of the apparatus, during the manufacture of the one piece frame slingshot, an elongated wire is initially bent into a U-shape and then further shaped to the preferred one piece frame configuration, using a wire forming mold, which includes: a base; upward extending posts; and a horizontal rod. The U-shaped wire is insertably positioned on the base and then selectively and sequentially wound around the upward extending posts and the horizontal rod to create the shape of the one piece frame of this slingshot in its preferred embodiment.

10 Claims, 7 Drawing Figures

FIG. 3
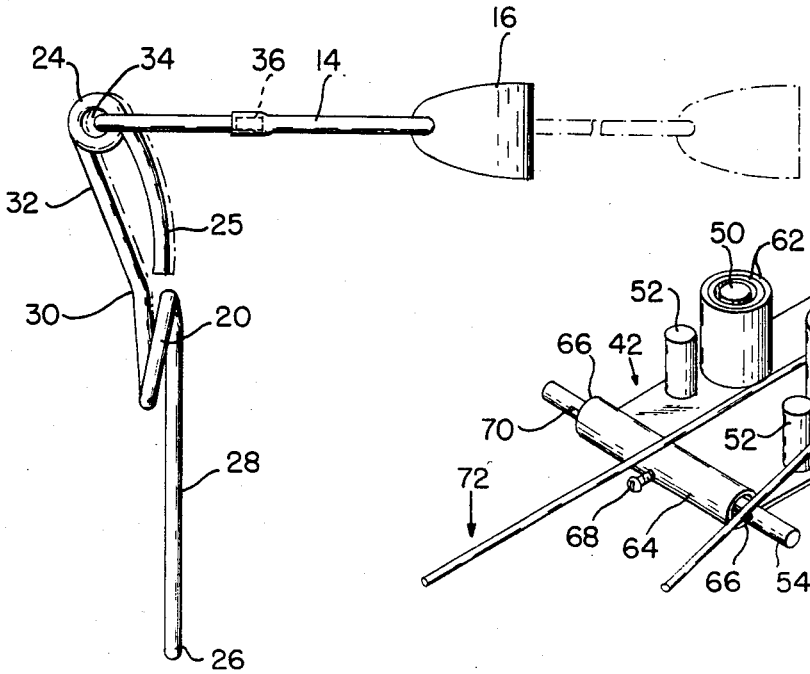
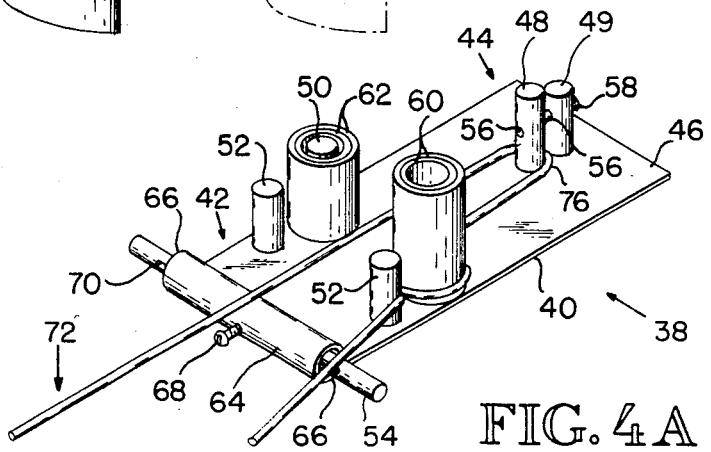
FIG. 4A
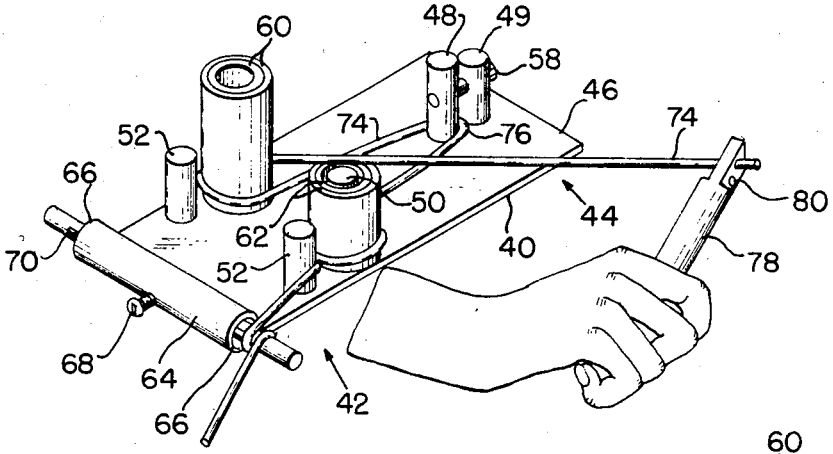
FIG. 4B
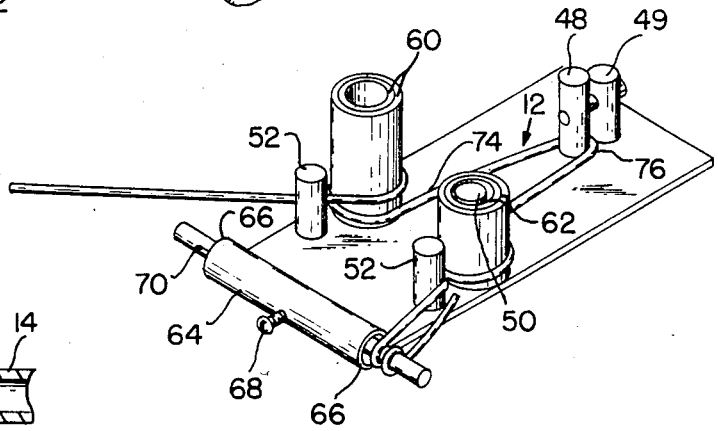
FIG. 4C
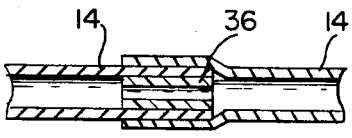
FIG. 5

HAND HELD SURE GRIP SLINGSHOT INCLUDING A METHOD AND APPARATUS FOR ITS MANUFACTURE

BACKGROUND OF THE INVENTION

Few recent developments have been made with regard to slingshots despite their continued popularity for sport and leisure activity. There have been and still remain several objectives, such as the important requirement during accurate operation of a hand held slingshot to significantly minimize rotational movement of the slingshot in the operator's hand during the launching of a projectile. Another important requirement or technique to increase accuracy and performance in using the slingshot is to construct a Y-shaped handle so the upper portion of a handle grip will resist the bending moment of the extending arm portions of the overall Y-shaped handle, when the sling is drawn back to launch a projectile.

Presently available slingshots or catapults offered on the market today do not completely meet these objectives or requirements of design, construction, and operation. In regard to slingshots offered and being offered for sale, attention has been focused on other ways and means to improve their accuracy such as variations in construction and materials used for the sling portion and/or handles as well as a variety of sights. By way of example:

O. H. Curtis is his U.S. Pat. No. 225,510 illustrates a one piece wire device having arms and a handle. Various loops are formed to secure the endless elastic strap to the handle. A centrally located arrow rest is formed from a central loop of wire to guide projectiles during launching;

F. W. Pratt and B. J. Dickinson describe a toy catapult in their U.S. Pat. No. 1,072,988 in which vertically positioned coil springs are secured to the arms of the toy catapult to permit the sling to be stretched rather than using elastic material or rubber for the sling. The toy catapult also includes a looping metal handle and a looping wire sight mounted on a horizontal cross bar above the sling's trajectory;

Further developments focused on simplicity of manufacture such as W. L. Walker's sling shot in his U.S. Pat. No. 2,443,408. Walker eliminated the use of a structural frame or handle, simply using elastic members which were secured to thumb and finger stalls which were in turn inserted, over the thumb and index finger of the operator's hand; and R. Laubly in his U.S. Pat. No. 2,585,663 discloses a slingshot which utilizes a one piece elastic element which is enclosed within a rigid handle. The solid and sturdy handle is generally constructed of a composite material requiring molding processes and assembly of various parts.

None of the foregoing inventions or others offered for sale provide for means to firmly secure the handle of the slingshot within the operator's hand to prevent rotational movement of the frame. This feature is particularly important when unequal tension is put on the elastic members when the sling is drawn back at an angle from the handle and/or frame. The resulting increased strain put on one of the arms of the frame and/or handle often results in rotational movement of the frame and/or handle in the operator's hand. There remains a need, therefore, to provide a simple and inexpensive hand held slingshot, wherein the handle is designed to be held to ably resist the bending moment of the slingshot arms, as well as to resist any overall rotational movement of the slingshot, during its use. In reaching these objectives there remains a need to provide an inexpensive and uncomplicated method of manufacture of high quality slingshots for accurate shooting.

SUMMARY OF THE INVENTION

A hand held sure grip slingshot including a method and apparatus for its manufacture are provided for the very accurate launching of projectiles. The slingshot utilizes a one piece frame, which may be adaptively and adequately secured in the operator's hand to prevent any relative rotational twisting and/or sliding of the handle during use of the slingshot. This one piece frame comprises a handle, intermediately positioned looping finger guides at the top of the handle, upward extending and separating arms and spiral retaining loops at the tops of the arms. The looping finger guides comprise effective apertures through which fingers of the operator's hand may be insertably positioned to grip the one piece frame during use of the slingshot. The spiral configuration of the looping finger guides positions the upward extending separating arms supportively in front of the handle which thereby resists the bending moment of the upward extending arms, when a pair of elastic members, comprising the sling, are pulled rearwardly to launch a projectile. The elastic members are insertably secured to the spiral retaining loops to attach the elastic sling to the one piece frame.

The apparatus used to manufacture the slingshot, is a wire forming mold to receive an elongated wire, first bent into a U-shape and then, via the wire forming mold, formed into the preferred embodiment of the one piece frame. The wire forming mold is comprised of a base having a plurality of selectively positioned upward extending posts upstanding from the base and a horizontal rod secured to the end of the base. The upward extending posts further comprise bottom posts, finger guide posts, and retaining posts. One or more cylindrical sleeves of varying diameter are removably and interchangeably inserted over each of the finger guide posts to provide a circumferential form for the looping finger guides of the one piece frame.

During the steps of the method of manufacture, after first bending of the wire into the U-shaped portion, this U-shaped wire is insertably secured between the bottom posts at the lower end of the base. The wire is then selectively and sequentially bent and wrapped around the cylindrical sleeves, shaping the looping finger guides. The balance of the ends of the wire are then extended to form the upward extending arms and thereafter they are spirally twisted around the horizontal rod to form the spiral retaining loops at the top of the upward extending arms.

DESCRIPTION OF THE DRAWINGS

The preferred embodiment of the slingshot as well as the method and wire forming mold apparatus for the manufacture of the slingshot are illustrated in the drawings, wherein:

FIG. 3 is a side view of the sure grip slingshot. A portion of the sling is also shown in phantom as it is pulled rearwardly in anticipation of launching a projectile.

FIGS. 4*a*, 4*b* and 4*c* are perspective views of the wire forming mold, illustrating the method of manufacture of the one piece frame of the slingshot.

FIG. 4*a* illustrates the first completed looping finger guide, which has been shaped and bent around the tall cylindrical sleeve.

FIG. 4*b* illustrates the formation of the opposite looping finger guide with the tall cylindrical sleeve now being positioned on the opposite finger guide post thus permitting the balance of the end of the wire to pass over the short cylindrical sleeve during the wrapping process.

FIG. 4*c* illustrates the completion of a spiral retaining loop, being wrapped around the end of the horizontal rod.

FIG. 5 is an enlarged sectional view of the sling, particularly the elastic members and the insert, also shown in FIG. 3, which interconnects the ends of each elastic member to form a loop.

DESCRIPTION OF THE PREFERRED EMBODIMENT

Introduction

Figure 1:
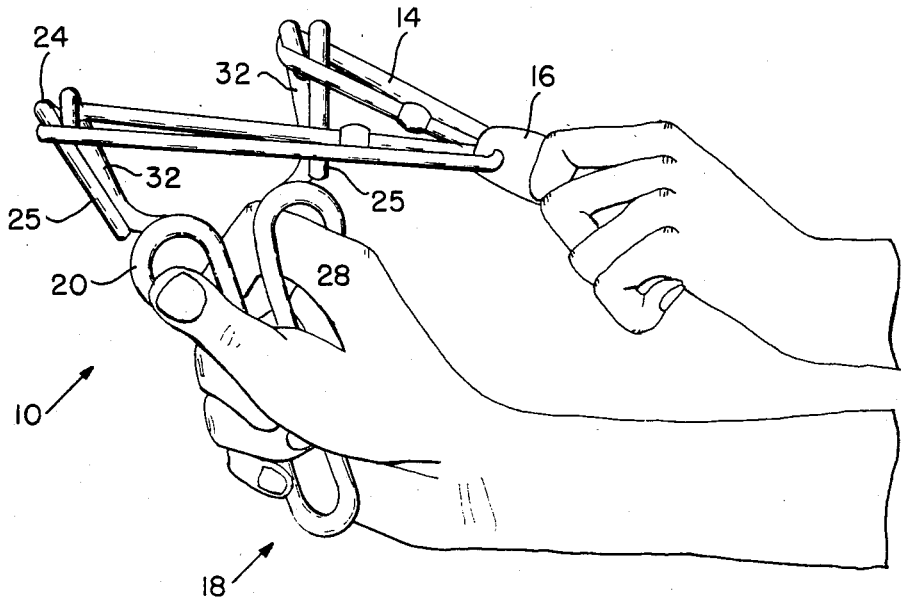
FIG. 1 is an environmental view showing the sure grip slingshot adaptively positioned in the operator's hand during its use.
Figure 2:
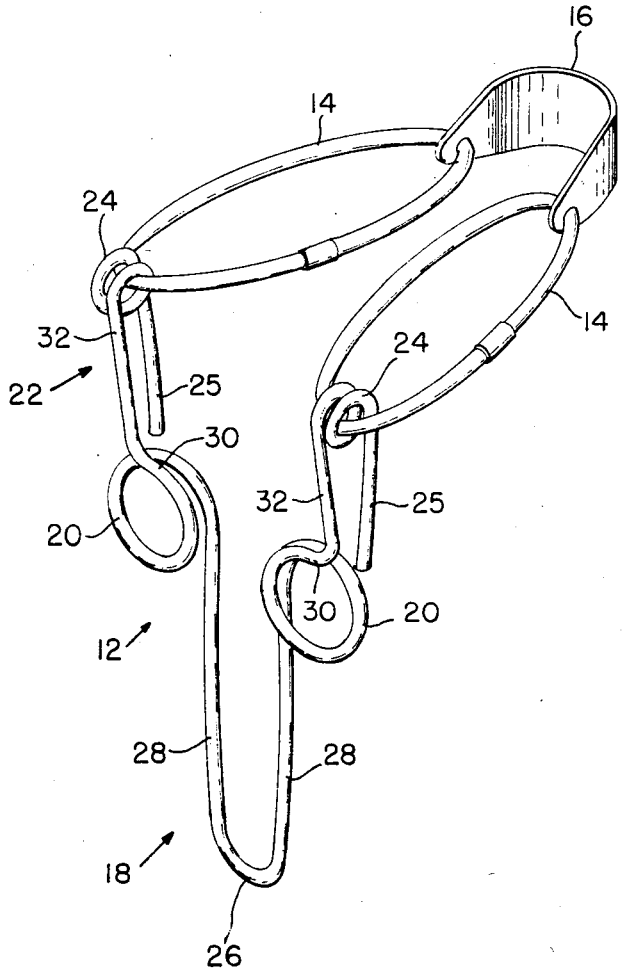
FIG. 2 is a perspective view of the sure grip slingshot.

The hand held sure grip slingshot 10 is shown in use in the operator's hand in FIG. 1 of the drawings. This slingshot 10 when viewed as assembled includes a one piece frame 12 and a sling, which includes a pair of elastic members 14 and a pouch 16. As shown in FIGS. 1 and 2, the one piece frame 12 is designed and constructed to be adaptively and securely held in the operator's hand while minimizing twisting and/or slipping of the one piece frame during operation of the slingshot 10.

The slingshot invention includes an apparatus and method of manufacture of the one piece frame 12. As shown in FIGS. 1, 2 and 3, the slingshot 10 is preferably constructed from structural wire using a wire forming mold 38. A method for bending the wire and wrapping the one piece frame 12 into the shape of the specific configuration of the preferred embodiment has been developed as an efficient means of manufacture of the slingshot 10 in combination with use of the wire forming mold 38.

The Sure Grip Slingshot Comprises a One Piece Frame

The one piece frame 12 of the slingshot is preferably comprised of a single piece of structural wire and comprises a handle 18, a pair of looping finger guides 20 at the top of the handle, a pair of upward extending arms 22, i.e. upward extending and separating arms 22, and spiral retaining loops 24 at the tops of the upward extending arms. Viewing the one piece frame 12 in the upright operating position, such as in FIGS. 1 and 2, the handle 18 is located at the lower end of the frame 12 and has a curved portion 26 at its bottom with extension members 28 depending upward from the curved portion 28 to form the handle. Together the upward extending arms and the handle form a Y-shaped configuration.

Looping finger guides 20 depend from the extension members 28 on opposite sides of the handle 18, being positioned adjacent to and on the outside of the handle 18 and located intermediately within the one piece frame 12 as shown in FIGS. 1 and 2.

Upward extending arms 22 depend from the top end of the looping finger guides 20 and are positioned at the upper end of the one piece frame 12 as shown in FIGS. 2 and 3, each upward extending arm 22 having an angled portion 30 and an upright portion 32.

At the top of the upward extending arms 22, spiral retaining loops 24 depend from the upright portions 32 wherein the top ends of the upward extending arms 22 are coiled in spiral fashion outwardly away from the upward extending arms 22 and then finally extend downwardly, comprising downward portions 25 which are positioned in parallel alignment with the upright portions 32 as shown in FIGS. 1, 2 and 3.

The Looping Finger Guides of the One Piece Frame

The looping finger guides 20 comprise symmetrically shaped loops which depend outwardly from the handle 18 and form effective apertures through which fingers of the operator's hand may be inserted to securely grip and steady the slingshot 10 and prevent relative rotatable twisting and/or slipping during its operational use.

The top ends of the extension members 28 of the handle 18 curve outwardly, then loop under such that the looping finger guides 20 are spirally coiled in a direction forward of the one piece frame 12 as shown in FIGS. 2 and 3. The ends of the looping finger guides 20 then extend upwardly to integrally connect the upwardly extending arms 22. In this configuration of the preferred embodiment, the upwardly extending arms 22 are now in a forward position, being supportively positioned in front of the handle 18 which is now in a rearward position as shown in FIG. 3. The extension members 28 of the handle 18 and the rearward spiral portion of the looping finger guides 20 thus help to resist the bending moment of the upward extending arms 22 and forward spiral portion of the looping finger guides 20 as the sling is pulled back in anticipation of launching a projectile. The looping finger guides 20, as shown in FIG. 2, lie substantially in the same plane with the handle 18 and upward extending arms 22 of the one piece frame 12.

The Sling of the Sure Grip Slingshot Comprises a Pair of Elastic Members and a Pouch In the preferred embodiment of the slingshot 10, as shown in FIGS. 1, 2 and 3, the sling comprises a pair of elastic members 14, each of which are interconnected to form loops and are made of elastic material such as latex rubber. The elastic members 14 are each secured to an upward extending arm 22 of the frame 12 by being insertably threaded through the spiral retaining loop 24.

A pouch 13 is attached to both elastic members 14 to complete the sling as shown in FIGS. 1, 2 and 3. In the preferred embodiment of the slingshot 10, each elastic member 14 is insertably connected to the pouch 16 through an aperture located at opposite ends of the pouch 16.

The ends of the elastic members 14 are interconnected by using inserts 36 which are preferably made of hard plastic or rubber. The cylindrically shaped inserts 36 are then inserted into one end of the latex tubing and thereafter such end being inserted into the opposite end of the latex tubing whereby the ends of the tubing are held together by friction as shown in FIG. 5.

The sling may be alternatively made with single strand elastic members.

A Wire Forming Mold is Used to Construct the One Piece Frame of the Slingshot

As shown in FIGS. 4*a*, 4*b* and 4*c*, a wire forming mold 38 is used to shape and construct the one piece frame 12 of the slingshsot and may be secured to a bench or table top using conventional means such as bolts or clamps.

The wire forming mold 38 is generally comprised of a base 40 having an upper end 42 and lower end 44; upward extending posts, which depend vertically from the top surface 46 of the base 40; and a horizontal rod 54.

The upward extending posts include bottom posts 48, finger guide posts 50 and retaining posts 52.

While the wire forming mold 38 may be adaptively secured on a horizontal work table surface, reference is made to the upright hand held operating position of the slingshot 10 in describing upper 42 and lower 44 ends of the wire forming mold 38 and top and bottom locations of various components of the one piece frame 12 as well as the method of its manufacture which is discussed later.

A pair of bottom posts 48 are spaced closely apart longitudinally and secured to the base 40 at its lower end 44. Aligned concentric apertures 56 extend through both posts 48 near their top ends through which a pin 58 or nail is inserted to secure the U-shaped portion 76 of wire between the bottom posts 48 during manufacture of the one piece frame 12.

A pair of finger guide posts 50 are located intermediately on the base 40, being spaced apart and secured to the top surface 46 adjacent to the sides of the base 40 as shown in FIGS. 4*a*, 4*b* and 4*c*. The bottom posts 48 are spaced equidistant from the sides of the base 40 and lie on a median between the finger guide posts 50, being equidistant from each finger guide post 50.

As shown in FIGS. 4*a*, 4*b* and 4*c*, a pair of retaining posts 52 are spaced closely apart above and longitudinally aligned with the finger guide posts 50, being secured to the top surface 46 of the base 40 adjacent to the finger guide posts 50.

A plurality of interchangeable removable cylindrical sleeves of varying diameter, including tall cylindrical sleeves 60 and short cylindrical sleeves 62, are slidably positioned over and surround the finger guide posts 50 as shown in FIGS. 4*a*, 4*b* and 5*c* to provide a circumferential mold around which the elongated portions 74 of the wire are wrapped to form the looping finger guides 20 on the one piece frame 12 of the slingshot 10. The variable diameters of the cylindrical sleeves permit different sized looping finger guides 20 with appropriate sized apertures to be formed to better fit the fingers of the operator's hand. The tall 60 and short 62 cylindrical sleeves may be interchanged on the finger guide posts 50 to permit the elongated portions 74 of wire to be wrapped around the tall cylindrical sleeves 60 on one finger guide post 50 while passing over the top of the short cylindrical sleeves 62 on the opposite finger guide post 50 to thus permit completion of the forming of the looping finger guides 20 around the tall cylindrical sleeves 60 as shown in FIG. 4*b* of the drawings.

The horizontal rod 54 is positioned laterally across the upper end 42 of the base 40 and is slidingly secured within a cylinder 64 which is secured to the top surface 46 of the base 40 as shown in FIGS. 4*a*, 4*b* and 4*c*. When centrally positioned within the cylinder 64, the ends of the horizontal rod 54 extend beyond the openings of the cylinder 64 to receive the top ends of the upward extending arms 22 which are then wrapped around the horizontal rod 54 to form spiral retaining loops 24 as shown in FIGS. 4*b* and 4*c*.

The horizontal rod 54 is secured in place within the cylinder 64 by a screw 68 which is inserted through an aperture in the cylinder 64 as shown in FIG. 4*a*. A longitudinal groove 70 extends substantially the entire length of the horizontal rod 54 within which the screw 68 is seated. Retracting the screw 68 slightly yet keeping the screw partially seated within the groove 70 permits adjustability of the horizontal rod 54, allowing the horizontal rod 54 to slide back and forth within the cylinder 64 for a distance equal to the length of the groove 70. The ends of the horizontal rod 54 are thus permitted to be alternately slidably retracted within the cylinder 64 to facilitate removal of the one piece frame 12 from the wire forming mold 38. The cylinder 64 is secured to the top surface 46 of the base 40 by welding for example.

Method of Manufacture of the Sure Grip Slingshot Using the Wire Forming Mold

The method of manufacture of the sure grip slingshot 10 includes shaping of the one piece frame 12 which is preferably made from a single elongated length of wire 72 or wire 72. The sequential method of bending the wire 72 into the preferred embodiment configuration is shown in FIGS. 4*a*, 4*b* and 4*c* of the drawings.

The length of wire 72 is first selected from stock lengths of wire or a spool and then bent into a U-shaped configuration by essentially doubling the wire 72 in two.

The wire 72 is next inserted at its U-shaped portion 76 between the bottom posts 48 at the lower end 44 of the base 40 and secured in place with a pin 58 which is secured in concentric apertures 56. The elongated portions 74 of the wire 72 are squeezed toward each other into parallel alignment and wrapped at the U-shaped portion around the bottom post 48 whereby the elongated portions are then positioned inside of the finger guide posts 50 to now form the handle 18.

The tall cylindrical sleeves 60 are then placed over the finger guide post 50 around which the first looping finger guide 20 will be bent and shaped. An elongated portion 74 is then bent into position between the outermost tall cylindrical sleeve 60 and the adjacent retaining post 52 and then wrapped outwardly, away from the handle 18 in a spiral fashion around the tall cylindrical sleeve 60, looping under and then extending upwardly to form a looping finger guide 20. As the elongated portion 74 is wrapped around the tall cylindrical sleeves, the balance of the end of the elongated portion 74 passes over the short cylindrical sleeves 62 on the opposite finger guide post. The looping finger guide 20 is completed when the elongated portion 74 of wire is wrapped between the tall cylindrical sleeve 60 and the retaining post 52 a second time, the balance of the end of the elongated portion 74 now extending over the side of the base 40 as shown in FIG. 4*a*.

The tall cylindrical sleeves 60 are then interchanged with the short cylindrical sleeves 62 and placed over the opposite finger guide post 50. The second elongated portion 74 of wire is then wrapped outwardly around the newly placed outermost tall cylindrical sleeve 60 in a similar spiral fashion to shape the opposite looping finger guide 20 as shown in FIG. 4*b*. Viewing the one piece frame 12 in the upright normally hand held position on the wire forming mold 38, the right sided elongated portion of wire is wrapped in a clockwise direction while the left hand side elongated portion of wire is wrapped in a counterclockwise direction.

The balance of the ends of the elongated portions 74 of wire are then bent around the outsides of the retaining posts 52 and then straightened into the upright position, forming upward extending arms 22 as shown in FIG. 4*a*.

The upper ends of the elongated portions 74 of wire are then positioned over the top of the horizontal rod 54 and spirally wrapped in a counterclockwise direction around the horizontal rod 54, shown in FIG. 4*b*, finally extending in a downward direction toward the handle 18, to form spiral retaining loops 24 at the top ends of each upward extending arm 22 as shown in FIG. 4*c*. Each spiral retaining loop 24 is preferably formed by wrapping the elongated portion 74 of wire for one and one-half revolutions around the horizontal rod 54. The ends of the wire are then trimmed off leaving a small space between the downward portion 25 of the spiral retaining loop 24 and the adjacent looping finger guide 20 as shown in FIG. 4*c*.

The completely shaped one piece frame 12 is then detached from the wire forming mold 38 by retracting the screw 68 from the cylinder 64 securing the horizontal rod 54 and retractably sliding the horizontal rod 54 from each spiral retaining loop 24. The cylindrical sleeves are then removed from the finger guide posts 50 and the pin 58 secured through the bottom posts 48 is removed as well. Elastic members 14 of the sling may now be insertably attached to the spiral retaining loops 24 of the one piece frame 12.

A wrapping bar 78 may be used to bend the wire whereby the ends of the elongated portions 74 are inserted into apertures 80 at the end of the hand held wrapping bar 78 which thereby provides added leverage and assists in shaping the one piece frame 12.

I claim:

1. A hand held sure grip slingshot for accurate launching of projectiles to be adaptively and securely positioned in the operator's hand to minimize rotational and/or slidable movement of the slingshot during its use, comprising:

(a) a one piece frame, a handle at the lower end of the one piece frame, said handle having extension members and a curved portion; support members, intermediately located on the one piece frame and depending outwardly from opposite sides of and at the top of the handle, each of the support members further comprising a looping finger guide having an aperture through which the operator's fingers may be insertably positioned to prevent twisting and/or sliding of the one piece frame of the slingshot in the operator's hand during use; upward extending arms, spaced apart and depending upwardly from the support members; and spiral retaining loops depending from the upward extending arms at the upper end of the frame; and (b) a sling having a pair of elastic members of substantially equal length, each removably insertably secured within a spiral retaining loop of the one piece frame and also comprising a pouch which is secured at each end to an elastic member thereby connecting the two elastic members and the pouch together wherein the pouch is located intermediately along the length of the sling at equal distances on the unstretched sling from each upward extending arm.

2. A hand held sure grip slingshot as defined in claim 1 wherein the support members further comprise looping finger guides, having apertures through which the fingers of the operator's hand may be inserted, the looping finger guides being continuations of the extension members of the handle, curving outwardly and forwardly in a spiral fashion and looping under and then extending upwardly to integrally connect the upward extending arms, whereby the upward extending arms now in a relative forward position, are supportively positioned in front of the handle which is now in a relative rearward position; the extension members of the handle being positioned to resist the bending moment of the upward extending arms as the sling is pulled rearwardly in anticipation of launching a projectile.

3. A hand held sure grip slingshot as defined in claim 2 wherein the looping finger guides are symmetrical, being substantially coplanar with the handle and the upward extending arms of the one piece frame of the slingshot.

4. A hand held sure grip slingshot method of manufacture comprising shaping a one piece frame of the slingshot, using a wire forming mold having a bottom end and top end, wherein the method of shaping comprises:

(a) bending a selected length of wire into a U-shaped configuration;

(b) placing the now U-shaped length of wire, having a U-shaped portion and elongated portions, between cylindrical vertically extending posts located at the bottom end of and secured to the wire forming mold;

(c) alternately wrapping each of the elongated portions of wire around cylindrical, vertically extending posts, intermediately located on the wire forming mold, in a selected specific sequence, thereby shaping and forming looping finger guides which are postioned intermediately within the one piece frame;

(d) spirally twisting the balance of the ends of the elongated portions of wire around a horizontal rod which is slidingly secured within a cylinder and located at the top end of the wire forming mold; and (e) removal of a now completely shaped one piece frame from the wire forming mold by detachment from the vertically extending posts and the horizontal rod.

5. A hand held sure grip slingshot method of manufacture as defined in claim 4 wherein the method further comprises:

(a) inserting the length of wire at its U-shaped portion between two closely spaced cylindrical vertically extending posts which comprise bottom posts, and;

(b) squeezing the elongated portions of wire together into parallel alignment with each other, and;

(c) extending the elongated portions of wire toward the top end of the wire forming mold, and;

(d) positioning the elongated portions between cylindrical vertically extending posts, which comprise finger guide posts and adjacent retaining posts, which are located on opposite sides of the wire forming mold, to form a handle of the one piece frame.

6. A hand held sure grip slingshot method of manufacture as defined in claim 5, wherein after positioning the elongated ends of wire, the method further comprises:

(a) placing a cylindrical sleeve over each finger guide post, and;

(b) insertably positioning the ends of the elongated portions of wire between a cylindrical sleeve and adjacent retaining post, and;

(c) spirally winding the balance of the ends of each elongated portion of wire outwardly, away from the handle, around the cylindrical sleeve and then completing a loop around each sleeve, thereby forming looping finger guides, and;

(d) extending the remaining balance of each of the ends of the elongated portions of wire upwardly toward the top end of the wire forming mold, thereby forming upward extending arms, said upwardly extending arms now being positioned forward of the handle when viewed in the normally upright hand held operator's position.

7. A hand held sure grip slingshot method of manufacture as defined in claim 6 wherein after extending the elongated ends of wire, the method further comprises:

(a) positioning of the ends of the upwardly extending arms over the horizontal rod, which is positioned and slidably secured within the cylinder and laterally extending across the top end of the wire forming mold, and;

(b) spirally wrapping the ends of the upwardly extending arms in a relative counter clockwise direction around the horizontal rod to form spiral retaining loops as the top of each upward extending arm, and;

(c) extending the ends of the elongated portions of wire toward the handle upon completion of the forming of the spiral retaining loops.

8. A hand held sure grip slingshot method of manufacture as defined in claim 7 wherein the method comprises using a bar having an aperture at one end, the method further comprising:

(a) inserting the ends of the elongated portion of wire through the aperture of the bar, and;

(b) spirally winding the ends of the elongated portion of wire around the cylindrical sleeves and the horizontal rod using the bar, said bar increasing leverage in turning and shaping the U-shaped wire.

9. A hand held sure grip slingshot for accurate launching of projectiles to be adaptively and securely positioned in the operator's hand to minimize rotational and/or slidable movement of the slingshot during its use, comprising:

(a) a one piece frame including:

(i) a handle at the lower end of the one piece frame, said handle having extension members and a curved portion and;

(ii) support members, intermediately located on the one piece frame and depending outwardly from opposite sides of and at the top of the handle, wherein the support members further comprise looping finger guides, having apertures through which the fingers of the operator's hand may be inserted, the looping finger guides being continuations of the extension members of the handle, curving outwardly and forwardly in a spiral fashion and each looping under and then extending upwardly to integrally connect an upward extending arm and;

(iii) upward extending arms whereby the upward extending arms are now located in a relative forward position, and supportively positioned in front of the handle which is now in a relative rearward position; the extension members of the handle being positioned to resist the bending moment of the upward extending arms as a sling is pulled rearwardly in anticipation of launching a projectile, and;

(iv) spiral retaining loops depending from the upward extending arms at the upper end of the frame.

(b) a sling having a pair of elastic members of substantially equal length, each removably insertably secured within a spiral retaining loop of the one piece frame and also comprising a pouch which is secured at each end to an elastic member thereby connecting the two elastic members and the pouch together wherein the pouch is located intermediately along the length of the sling at equal distances on the unstretched sling from each upward extending arm.

10. A hand held sure grip slingshot as defined in claim 9 wherein the looping finger guides are symmetrical and substantially equal in size, being substantially coplanar with the handle and the upward extending arms of the one piece frame of the slingshot.

* * * * *